United States Patent [19]

Hofbauer et al.

[11] Patent Number: 4,485,788

[45] Date of Patent: Dec. 4, 1984

[54] FUEL INJECTION INSTALLATION FOR A MULTI-CYLINDER AIRCRAFT ENGINE

[75] Inventors: August Hofbauer, Pforzheim; Herbert Steinbeck, Hemmingen; Hans Weiner, Muehlacker, all of Fed. Rep. of Germany

[73] Assignee: Dr. Ing. h.c.F. Porsche Aktiengesellschaft, Stuttgart, Fed. Rep. of Germany

[21] Appl. No.: 541,255

[22] Filed: Oct. 12, 1983

[30] Foreign Application Priority Data

Oct. 13, 1982 [DE] Fed. Rep. of Germany ..... 3237964

[51] Int. Cl.[3] ..... F02M 39/00

[52] U.S. Cl. ..... 123/452; 123/497; 123/511

[58] Field of Search ..... 123/452, 453, 454, 455, 123/497, 498, 499, 495, 510, 511

[56] References Cited

U.S. PATENT DOCUMENTS

| | | | |
|---|---|---|---|
| 2,409,931 | 10/1946 | Curtis | 60/39.091 |
| 2,459,807 | 1/1949 | Gavin et al. | 123/530 |
| 2,821,972 | 2/1958 | Banker | 123/497 |
| 3,014,474 | 12/1961 | Banker | 123/515 |
| 3,680,536 | 8/1972 | Clark | 123/453 |
| 4,391,252 | 7/1983 | Jaggle et al. | 123/452 |

FOREIGN PATENT DOCUMENTS 1266053 10/1964 Fed. Rep. of Germany .

*Primary Examiner*—Magdalen Y. C. Moy
*Attorney, Agent, or Firm*—Craig & Burns

[57] ABSTRACT

A fuel injection system for a multi-cylinder aircraft engine in which, in order to secure the fuel supply, a pressure-measuring device is connected to the feed line leading from the fuel tank to the fuel quantity distributor, into which are installed two parallel fuel pumps and a fuel filter; this pressure-measuring device in case of a predetermined pressure drop switches on the fuel pump which previously was not in operation; in case of an excessive pressure difference at the fuel filter which is measured by pressure-measuring device upstream and downstream of the filter, an electromagnetic valve installed into a bypass line to the fuel filter is opened; the soiling degree of the fuel filter is indicated by a hydraulically actuated difference pressure-measuring device with pressure limitation.

7 Claims, 1 Drawing Figure

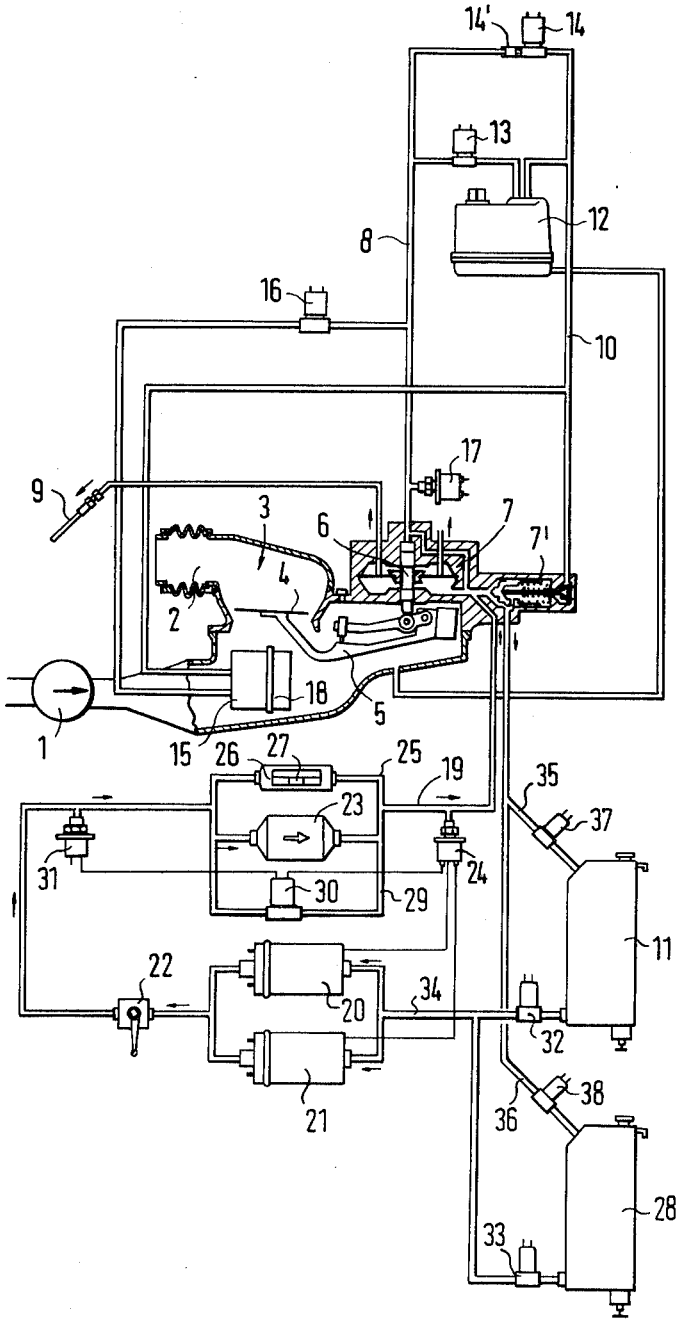
14'
14
13
12
8
16
10
17
9
3
6
7
7'
4
2
18
5
1
15
26
27
25
19
35
37
23
31
24
30
29
11
22
20
34
32
38
36
21
28
33

FUEL INJECTION INSTALLATION FOR A MULTI-CYLINDER AIRCRAFT ENGINE

The present invention relates to a continuously operating fuel injection installation for a multi-cylinder aircraft engine, in the suction pipe of which is installed a measuring device for the through-flowing air quantity which adjusts a control piston of a fuel quantity distributor to which are connected the injection valves coordinated to the cylinders.

Whether such a fuel injection system can be used for aircraft engines depends decisively on how safely it operates and what measures are undertaken for the case that a part important for the functioning fails. In particular, a fuel supply from the fuel tank to the fuel quantity distributor, which is free of failures, deserves particular attention.

It is the object of the present invention to so further develop a continuously operating fuel injection installation that in case of failures, an adequate engine operation is assured.

The underlying problems are solved according to the present invention in that the pressure in the feed line is measured by a pressure-measuring apparatus which controls the fuel pumps and which together with a further pressure-measuring device controls a valve installed into a by-pass line, bypassing the fuel filter. If the pressure-measuring device connected with the feed line indicates too low a pressure, then this is an indication that the electric fuel pump which is at that moment in operation, does not operate completely satisfactorily. The pressure-measuring device then engages the second fuel pump by means of a built-in switching contact at a predeterminable pressure decrease.

A further interference may occur by a clogging up of the fuel filter built into the feed line. In order to maintain the supply to the fuel quantity distributor, a bypass line bypassing the fuel filter is provided which is opened when the differential pressure between the upstream and downstream side of the fuel filter exceeds a predeterminable amount. For that purpose, the bypass line includes an electromagnetic valve which is controlled by the pressure-measuring devices.

These and other objects, features and advantages of the present invention will become more apparent from the following description when taken in connection with the accompanying drawing which shows, for purposes of illustration only, one embodiment in accordance with the present invention, and wherein:

The single FIGURE is a somewhat schematic view of a fuel injection installation for a multi-cylinder aircraft engine in accordance with the present invention.

Referring now to the single FIGURE of the drawing, air is supplied from a turbocharger 1 into the suction pipe 2 of a multi-cylinder aircraft engine, in which is located a measuring device generally designated by reference numeral 3 for measuring the through-flowing air quantity. The measuring device 3 is a baffle plate 4 arranged transversely to the flow direction of the air whose adjusting movement depending on the through-flow quantity is transmitted by way of a rotatably supported lever 5 to the one end face of the control piston 6 of a fuel quantity distributor 7. The other end face of the control piston 6 is acted upon by the pressure of a control pressure line 8, which pressure acts as return force for the measuring device 3. Depending on the position of the control piston 6, more or less fuel is distributed uniformly to the injection valves 9, of which one each is coordinated to a cylinder of the aircraft engine.

A warm-up regulator 12 is connected between the control pressure line 8 and the return line 10 of the fuel to the fuel tank 11; the warm-up regulator may be of the type as described in the publication "Bosch, Technische Unterrichtung, Benzineinspritzung K-Jetronic," on pages 14 and 15, Feb. 28, 1974. An electromagnetic valve 13 is connected ahead of the warm-up regulator 12, which is actuatable automatically or manually by switching. A fixed throttle 14 is connected in parallel to the warm-up regulator 12 between the control pressure line 8 and the return line 10 and a height control pressure regulator 15 is connected in a further parallel line, which is also adapted to be engaged and disengaged by an electromagnetic valve 16 connected ahead thereof. The pressure of the control line 8 is monitored by a pressure-measuring device 17 connected therewith. The height control pressure regulator 15 includes a gas-filled diaphragm box 18; it is arranged in the suction pipe 2 directly below the baffle plate 4 and thus measures the temperature and the pressure of the air supplied by the turbocharger 1 at the same location, at which will also be determined the through-flow quantity by the measuring device 3.

The fuel supply takes place by way of two electric fuel pumps 20 and 21 arranged in parallel in a feed line 19, which suck-in the fuel from the fuel tanks 11 and 28 coordinated thereto and feed the same to the fuel quantity distributor 7 by way of a manually actuated valve 22 and a fuel filter 23. A pressure-measuring device 24 is connected to the line from the fuel filter 23 to the fuel quantity distributor 7 which controls the fuel pumps 20 and 21 by way of built-in switching contacts. A difference pressure limiting valve 26 is connected into a bypass line 25 bypassing the fuel filter 23, which is equipped with a filter soiling indicator 27.

A further bypass line 29 includes an electromagnetic valve 30 which is controllable by the differential pressure of the pressure-measuring device 24 and of the pressure-measuring device 31. In this manner, in case of filter soiling, a bypass with nearly resistance-free through-flow cross section is created so that a fuel warm-up at this location is precluded. Each of the two fuel tanks 11 and 28 is connected by way of an electromagnetic valve 32, respectively, 33 with a common connecting line 34 leading to the fuel pumps 20 and 21. Electromagnetic valves 37 and 38 are also interconnected in the return lines 35 and 36 from the fuel quantity distributor 7 to the fuel tanks 11 and 28. The electromagnetic valves 32, 33, 37 and 38 are so controlled that with engagement of one fuel pump 20 or 21, the feed line from and the return line 2 the associate fuel tank 11, respectively, 28 is open. It is also within the scope of the present invention to thereby automatically engage the two fuel pumps 20 and 21 alternately for predetermined equal periods of time by the use of conventional controls, whereby one fuel tank (11, respectively, 28) is then coordinated to each fuel pump (20, respectively, 21) and the fuel tanks (11, 28) are connected to the fuel pumps (20, 21) by way of a common connecting line (35).

In case of disturbance or failure of the engaged fuel pump and of the coordinated supply system, also the feed and return of the corresponding fuel tank is opened upon engagement of the other fuel pump by the pressure-measuring device 24. Additionally, by the manual control of the electromagnetic valves, the change of the fuel supply from one to the other fuel tank is made possible by way of the return line. Thus, a trimming of the aircraft can be achieved or in case of tank leakage a maximum fuel supply can be assured by changing from one to another fuel tank.

While we have shown and described only one embodiment in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A continuously operating fuel injection installation for a multi-cylinder aircraft engine, comprising suction pipe means, air quantity measuring means in said suction pipe means for measuring the through-flowing air quantity, a fuel quantity distributor means including control piston means, said control piston means being correspondingly adjusted by said air quantity measuring means, injection valves coordinated to the cylinders of the engine and operatively connected to the fuel distributor means, the fuel reaching the fuel distributor means by way of an inlet line, into which are interconnected at least a fuel filter and two electric fuel pump means disposed parallel to one another, characterized in that the pressure in the inlet line is measured by a pressure-measuring means operable to control the fuel pump means and operable to control together with a further pressure-measuring means a valve means connected into a bypass line bypassing the fuel filter.

2. A fuel injection installation according to claim 1, characterized in that a difference pressure limiting valve means is connected into a further bypass line which opens at a predetermined differential pressure of the supplied fuel.

3. A fuel injection installation according to claim 2, characterized in that the further bypass line includes indicating means for indicating the filter soiling.

4. A fuel injection installation according to claim 3, characterized in that during normal operation one fuel pump means is engaged and in case of a pressure drop in the inlet line the second fuel pump means is engaged by way of the pressure-measuring means.

5. A fuel injection installation according to claim 4, characterized in that both fuel pump means are automatically engaged alternately for predetermined substantially equal time periods, whereby one fuel tank is coordinated to each fuel pump means and the fuel tanks are connected to a common connecting line leading to the fuel pump means by way of electromagnetic valve means.

6. A fuel injection installation according to claim 1, characterized in that during normal operation one fuel pump means is engaged and in case of a pressure drop in the inlet line the second fuel pump means is engaged by way of the pressure-measuring means.

7. A fuel injection installation according to claim 6, characterized in that both fuel pump means are automatically engaged alternately for predetermined substantially equal time periods, whereby one fuel tank is coordinated to each fuel pump means and the fuel tanks are connected to a common connecting line leading to the fuel pump means by way of electromagnetic valve means.

* * * * *